US005087858A

United States Patent [19]

Cherry et al.

[11] Patent Number: 5,087,858

[45] Date of Patent: Feb. 11, 1992

[54] GAS DISCHARGE SWITCHED EL DISPLAY

[75] Inventors: Walter L. Cherry, Waukegan, Ill.; George A. Kupsky, El Paso, Tex.

[73] Assignee: Cherry Display Products Corporation, El Paso, Tex.

[21] Appl. No.: 393,639

[22] Filed: Aug. 14, 1989

[51] Int. Cl.[5] ..... G09G 3/10

[52] U.S. Cl. ..... 315/169.3; 340/781; 313/485

[58] Field of Search ..... 315/169.3, 169.4; 340/781, 811, 825.81, 701, 718, 772; 313/485, 484

[56] References Cited

U.S. PATENT DOCUMENTS 3,589,789 6/1971 Hubert et al. ..... 313/485 X 4,429,303 1/1984 Aboelfotoh ..... 313/485 X

*Primary Examiner*—Eugene R. LaRoche

*Assistant Examiner*—Ali Neyzari

*Attorney, Agent, or Firm*—Willian Brinks Olds Hofer Gilson & Lione

[57] ABSTRACT

A flat panel X-Y matrix display has gas discharge switches which are disposed in capacitive series contact with associated electroluminescent cells. The gas discharge switches are selectively ionized to continuously energize and light the EL cells until the switches are turned off. The switches thus provide an active energization matrix for the cells.

3 Claims, 3 Drawing Sheets

GAS DISCHARGE SWITCHED EL DISPLAY

TECHNICAL FIELD

This invention relates to an improved matrix display with electroluminescent display cells which are energized by an active matrix of AC gas discharge switches.

BACKGROUND OF THE INVENTION

Electroluminescence is the emission of light from a crystalline phosphor due to the application of an electric field. A commonly used phosphor material is zinc sulfide which may be activated by the introduction of various elements such as manganese into its lattice structure. When such a material is subjected to the influence of an electric field of a sufficient magnitude, it emits light of a color which is characteristic of the composition of the phosphor.

Two major subdivisions of electroluminescent devices are defined in terms of the intended alternating current (AC) or direct current (DC) operating modes. In DC configurations, the phosphor pixels of the panel are caused to luminesce in response to the conduction of electricity through the pixels. In AC configurations, the pixels luminesce in response to capacitively coupled electrical energy. AC electroluminescent devices may be made in either a thin-film or a thick-film configuration. In the thick-film configuration, powder phosphors are formed by precipitating powder phosphor crystals of the proper grain size, suspending the powder in a lacquer-like vehicle, and then applying the suspension to a substrate, for example, by spraying, screening or doctorblading techniques. Thin-film phosphors are grown from condensation of evaporants from vacuum vapor depositions, sputtering or chemical vapor depositions.

The present invention has particular applicability in relation to thick-film and thin-film AC electroluminescent matrix displays. Such matrix display panels can be used for a variety of applications, and in general, can find utility as substitutes for cathode ray tubes (CRTs), wherever CRTs are used. For example, matrix display panels can be used for such applications as oscilloscopes, television sets and monitors for computers. An electroluminescent matrix display panel is desirable because it provides a flat panel display which is much more compact than a corresponding CRT display.

AC matrix electroluminescent displays having, for example, 640 column×200 row matrix-addressable display pixels have been provided in the industry. Such displays are conventionally energized by sequentially scanning the 200 rows of the display and, as each row is scanned, applying column data for the scanned row. This technique is known as multiplexing In such a conventional pulsed energization scheme, each pixel of the panel is turned on or is energized with a duty cycle which is approximately 0.005. Such pulsed matrix displays have been known to provide images having an average intensity of approximately 30 foot lamberts (FL). This relatively low intensity image is produced by having the pixels radiate at an instantaneous amplitude of about 6,000 FL. Although a monochromatic display of manganese doped zinc sulfide is capable of providing such luminance in response to pulsed energization, it has not heretofore been possible to provide such luminance with red, green, blue (RGB) electroluminescent phosphors. Accordingly, although relatively satisfactory pulsed monochrome AC electroluminescent displays have been provided, it has not been possible to provide a color display with a suitable luminance.

Certain display technologies have resolved the problem of low luminance pulsed energization by providing active energization matrices which continuously energize an addressed pixel and therefore operate the pixel with a duty cycle of unity. Such constantly energized pixels can provide a total luminance in a matrix display which is orders of magnitude greater than would be provided in a pulsed energization mode.

Some liquid crystal displays (LCDs) utilize thin-film transistors or diodes and capacitors at each pixel of the display to maintain a charge on each addressed pixel and therefore provide for constant energization and illumination of the pixel. Although color images have been provided with such displays, it has been extremely difficult to provide the high density of thin-film transistors which are required to energize pixels in such a fashion. Indeed, at the present state of the art, although large screen displays are possible in principle, it has been difficult to manufacture such displays reliably and inexpensively. Also, although the thin-film driving transistor approach may be suitable for use with low power LCDs, such an approach is not considered practical for use with electroluminescent displays which require a substantial amount of power to provide a desired luminance. Accordingly, it is not desirable to drive the pixels of an electroluminescent display by using thin-film transistors.

AC gas discharge matrix-addressed displays have been designed to operate so that each addressed pixel may be energized and lighted with a 100 percent (unity) duty cycle. In such a device, each pixel continuously receives a high frequency sustaining voltage of, for example, 10–50 khz which is below the ignition level of plasma gas located in the envelope of the display. An unaddressed pixel therefore remains off. However, when any pixel is addressed by applying momentarily an additional write voltage which is properly synchronized with the sustaining voltage, the gas is ionized and ignition takes place at that pixel. Moreover, due to the sustained pixel wall voltage and the decay time of the ionized gas, that pixel, once addressed, continues to conduct in an AC sense until it is turned off by a synchronized erase voltage pulse of sufficient amplitude and proper polarity. The erase pulse momentarily reduces the wall voltage to a value below that required to sustain ionization.

Thus, once turned on, a pixel of a properly designed AC gas plasma display remains on until turned off. It operates at 100 percent duty cycle in an AC sense, and requires no connections other than its two power leads to operate in this fashion.

Gas discharge/phosphor hybrid displays have been proposed. Such displays have attempted to use an ionized plasma to excite a phosphor to luminescence. Thus, there have been attempts to construct a hybrid display wherein electrons derived from ionization of the plasma are directed to energize phosphor pixels It has also been suggested that ultraviolet light given off by a plasma could be used to energize phosphor pixels. One disadvantage of such hybrid displays is that the UV and ion bombardment degrades the phosphor. The literature does not report success with such plasma energization schemes.

Known displays have not been able to successfully combine the advantageous 100 percent duty cycle gas discharge drive technology with electroluminescent display elements The gas discharge switched electroluminescent (EL) display of the invention combines the advantageous features of gas discharge and EL technology by using gas discharge elements as switches in series with associated EL display cells. Thus, in the display of the invention, AC EL display elements and gas discharge switch elements are capacitively coupled but the phosphor is isolated from the plasma. In operation, the AC gas discharge elements act as on/off switches for the corresponding EL display cells and thereby provide a 100 percent duty cycle when the switches are turned on. None of the known display technologies uses this construction wherein each gas discharge switch controls the energy delivered to its associated isolated EL cell.

Accordingly, it is an object of the invention to provide a display which utilizes memory (i.e., continuous) gas discharge AC drive technology in association with AC electroluminescent display technology.

It is a further object of the invention to provide such a display wherein AC matrix gas discharge switches turn on and remain on, thus providing continuous energization for corresponding series connected and capacitively coupled AC EL cells.

SUMMARY OF THE INVENTION

In order to achieve the objects of the invention and to overcome the problems of the prior art, the matrix panel of the invention has gas discharge switches which are placed in series capacitive contact with adjacent AC EL display cells. The gas discharge switches are continuously energized by AC signals when addressed to provide continuous energization of their EL cells and an associated high luminance at a duty cycle of unity.

DETAILED DESCRIPTION

Figure 1A:
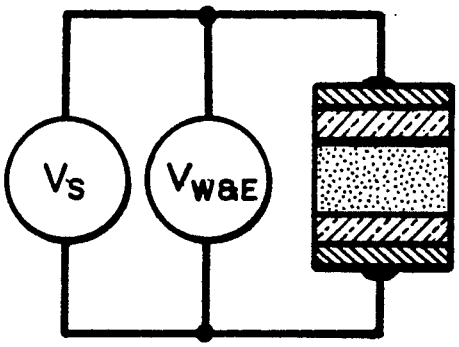
FIG. 1A is a diagrammatic illustration of an AC gas discharge display element which is known in the prior art.

The following is a description of embodiments of the invention with reference to FIGS. 1–6. In the figures, like reference numerals designate like elements or apparatus. FIG. 1A illustrates an AC gas discharge display element which is known in the art. As shown in FIG 1A, the element has outer conducting electrodes 1*a* and 1*b* which are disposed against associated dielectric layers 3*a* and 3*b* which may be made of glass. The dielectric layers 3*a*,3*b* form walls 7 of a gas chamber 5 which contains an ionizable gas. The gas in the chamber is provided to ionize in response to a particular sustaining voltage $V_s$ and write volta $V_w$ which are applied across the electrodes 1*a*,1*b*.

Figure 1B:
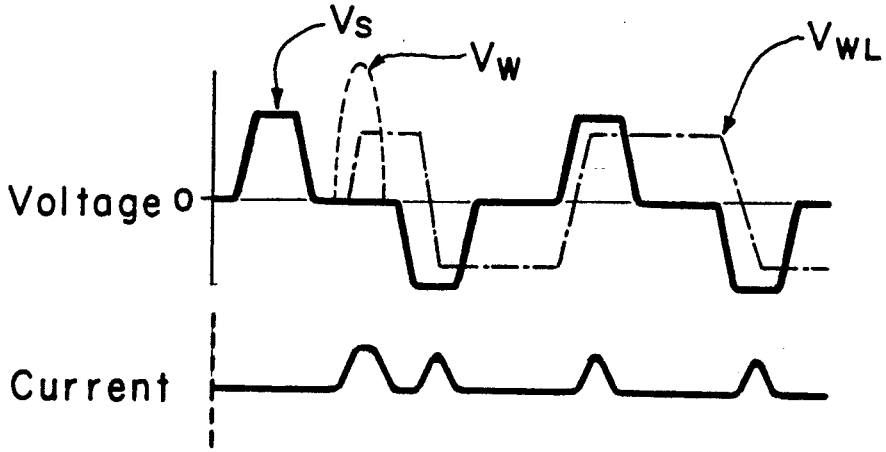
FIG. 1B is a timing diagram of operational voltages and associated current for energizing the gas discharge display element of FIG. 1A.

FIG. 1B illustrates the sustaining voltage $V_s$ and write pulse $V_w$ in association with a wall voltage $V_{WL}$ which occurs at the walls 7 of the gas discharge display element of FIG. 1A. It is known that the sustaining voltage $V_s$ may be applied in the form of a relatively high frequency AC signal of, for example, 10 to 50 khz. The magnitude of the sustaining voltage is selected so that it is below the ignition level at which the gas within the chamber 5 ionizes.

The sum of the sustaining voltage $V_s$ and the write voltage $V_w$ causes the total voltage to increase to a point where the gas within the chamber 5 ionizes. As shown in FIG. 1B, when a write voltage pulse $V_w$ is applied across the electrodes 1*a*, 1*b*, and the gas in the chamber ionizes and conducts, this produces an associated wall voltage $V_{WL}$ on the walls 7 of the dielectric 3*a*, 3*b* of the chamber 5 for the gas within the chamber. The gas remains in an ionized state even after the write pulse is removed, because the sum of the wall voltage and sustaining voltage is sufficient to sustain ionization of the gas. Accordingly, after the gas is initially ionized, the AC sustaining voltage is sufficient to continuously maintain the gas in an ionized state.

It should be appreciated that the sustaining voltage $V_s$ reverses polarity as an AC signal, and therefore the associated wall voltage $V_{WL}$ also reverses polarity. Although this polarity reversal results in the wall voltage passing through zero, the gas remains ionized, because of the decay time of the gas and discharge time constant for the wall voltage. The gas discharge element therefore remains on for as long as the sustaining voltage is maintained. The gas discharge element is therefore continuously "turned on in an AC sense." The phrase "turned on in an AC sense" means that the AC signal, $V_s$, maintains the ionized state of an associated AC gas discharge element.

FIG. 1B illustrates the current which flows in association with the energization of the gas discharge element of FIG. 1A. As shown in FIG. 1B, the current waveform 8 is produced in response to the sustaining voltage $V_s$ and the wall voltage $V_{WL}$ for the chamber 5.

Figure 1C:
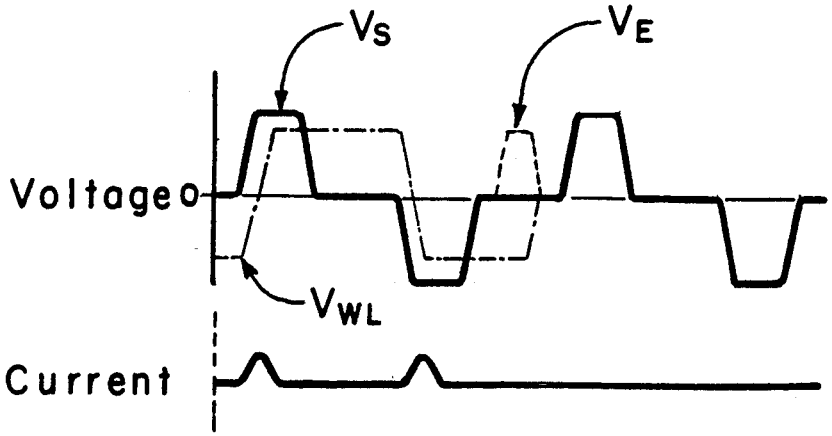
FIG. 1C is a timing diagram of operational voltages and associated current for de-energizing the gas discharge display element of FIG. 1A.

FIG. 1C illustrates the sustaining voltage $V_s$, wall voltage $V_{WL}$ and an associated erase voltage $V_E$ in association with the current signal 8. As shown in FIG. 1C, the energized AC gas discharge element of FIG. 1A is turned off in response to the erase pulse $V_E$ which has a polarity opposite the polarity of the wall voltage $V_{WL}$. When the erase voltage $V_E$ is applied in this manner, the wall voltage drops to a zero voltage or off state. In this condition there is no ionization and there is therefore no current 8 associated with the sustaining voltage $V_s$. The erase pulse $V_E$ therefore terminates the ionization within the gas chamber 5 and turns off the gas discharge element.

The operation of the described known gas discharge display element is advantageous in that it provides a relatively simple means to maintain a continuous AC energization of a gas discharge display element. Thus, in operation, the gas discharge display element has a pulsed duty cycle of 100 percent when it is turned on.

Figure 2:
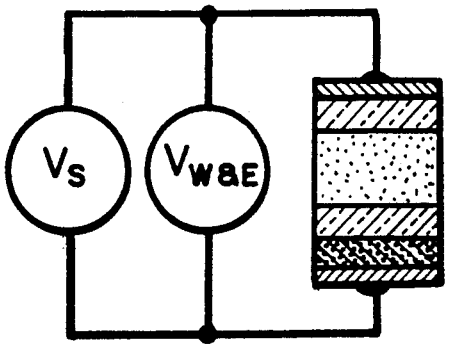
FIG. 2 is a diagrammatic illustration of a gas discharge switched electroluminescent display element in accordance with the invention.

FIG. 2 is a diagrammatic illustration of a single AC gas discharge switched electroluminescent (EL) display element 9 in accordance with the invention. This display element combines the advantageous continuous energization feature of an AC gas discharge display with an associated EL phosphor display cell. As shown in FIG. 2, the display element 9 has an AC gas discharge switch portion which includes electrodes 1a,1b, dielectric layers 3a,3b which are preferably opaque to ultraviolet radiation and an associated gas chamber 5 which is defined between the dielectric layers 3a,3b. The chamber 5 contains a gas which will ionize in response to a sustaining voltage $V_s$ and a write voltage $V_w$ in the manner previously described with respect to the gas discharge display element of FIG. 1A. The gas within the gas discharge switch of FIG. 2 may be selected to ionize at a particular desired combination of a sustaining voltage and write voltage, without requiring luminance.

The gas discharge switch of FIG. 2 contacts an associated EL phosphor layer 10 which forms an EL display cell in association with the electrode 1b which is also used to energize the gas discharge switch. The switch and EL cell are therefore capacitively connected in series. The dielectric layer 3b isolates the EL phosphor 10 physically from the plasma of the gas discharge switch and from the ultraviolet light produced by the plasma. The dielectric layers 3a and 3b are formed from a known glass frit which is opaque to ultraviolet radiation.

In operation, the gas discharge switch is turned on in response to a sustaining voltage $V_s$ and an associated write voltage pulse $V_w$. When the gas discharge switch is addressed and therefore turned on, an energization voltage pulse is applied to the associated adjacent abutting phosphor layer 10 and the phosphor is therefore energized and is caused to luminesce. The EL phosphor cell is maintained in a pulsed energized lighted condition because the sustaining voltage $V_s$ of the gas discharge switch maintains the energization voltage on the phosphor element for as long as the switch is turned on.

It should be understood that, although the illustrated gas discharge switch is used in association with an EL cell, the switch could also be used to activate and electrically energize another type of display cell, for example a liquid crystal cell. In essence, in accordance with the invention, a gas discharge switch may be used to provide an energization signal for any suitable series connected display cell.

Figure 3:
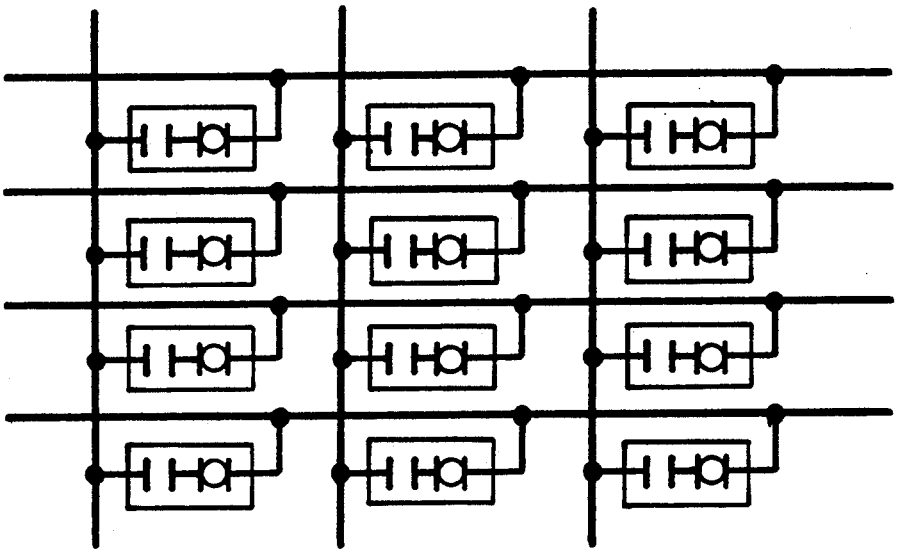
FIG. 3 is a diagrammatic illustration of a matrix of gas discharge switched electroluminescent elements having the structure of FIG. 2.

FIG. 3 is a diagrammatic illustration of a matrix which employs gas discharge switches 11 and associated EL phosphor cells 12 to provide a matrix of pixels in an X-Y display. In operation, the gas discharge switches 11 are selectively activated by applying sustaining voltage and write addressing voltages from selected X-Y column electrodes 13 and row electrodes 14.

When successive rows of the matrix of FIG. 3 are energized, associated column electrodes are synchronously energized to provide a desired display which is formed of lighted pixels. This display may be easily maintained by continuous energization of the associated gas discharge switches with a sustaining voltage. Accordingly, the matrix display has a continuous or 100 percent AC duty cycle which provides a high level of illumination when compared to the level of illumination of known EL panels.

Figure 4:
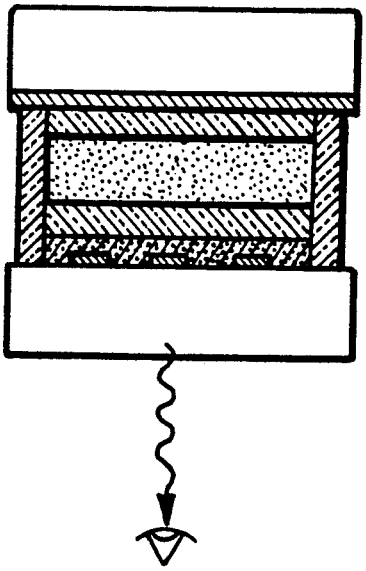
FIG. 4 is a diagrammatic cross-sectional view of a gas discharge switched electroluminescent matrix display in accordance with the invention.

FIG. 4 illustrates a diagrammatic crosssectional view of a matrix panel which includes the gas discharge switches and associated EL phosphor cells of FIGS. 2 and 3. As shown in FIG. 4, the matrix display has a front transparent substrate 15 which may be made of glass and associated column electrodes 13 which may be made of a suitable transparent conducting material of, for example, tin oxide. The column electrodes 13 are provided, for example, by vapor deposition, on the surface of the front substrate 15 in a parallel orientation. Associated parallel row electrodes 17 are placed on a rear substrate 19 which may be made of glass. The row electrodes 17 are orthogonal to the column electrodes and may be made of a suitable conducting material, such as nickel. The row electrodes may be formed by vapor deposition on the substrate 19. The matrix display includes dielectric layers 21a and 21b which form a hermetically sealed chamber 23 in association with side walls 25 which may also be made of glass or any other suitable nonconducting material. The hermetic seal may be provided, for example, by a gas impermeable frit. EL cells are formed by a phosphor layer 27 which may be made of suitable phosphors known to provide desirable luminescence in response to electrical energy.

In operation of the matrix panel of FIG. 4, solid state drivers (not shown) apply AC energization voltages in a known manner to selected column and row electrodes 13 and 17. If the row and column energization at a gas discharge switch and its associated EL cell is sufficient, the gas adjacent to the cross over of the activated row and column electrodes of the switch will ionize and an associated energization signal will be applied to light the EL cell. The EL cell will luminesce for as long as a sufficient AC sustaining voltage is applied across the switch and cell. Accordingly, each EL cell of the matrix panel of FIG. 4 will luminesce in response to its activated gas discharge switch. Lighted cells are viewed as shown at 18.

The gas of the ionization chamber for the matrix panel does not necessarily have to luminesce when it is ionized. Accordingly, any suitable inert gas, such as the Noble gases, may be used in the chamber to provide the required ionization and associated energization signal which is suitable for lighting display cells such as EL cells or liquid crystal cells.

Figure 5:
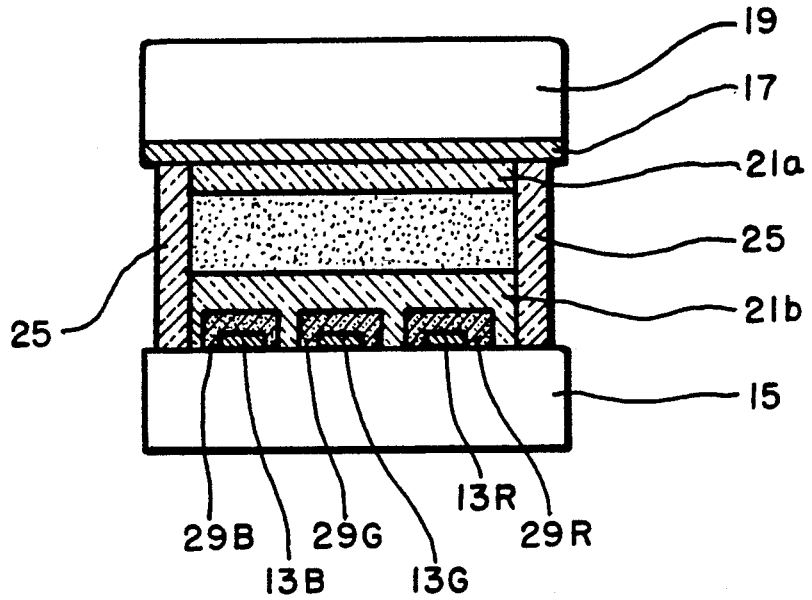
FIG. 5 is a diagrammatic cross-sectional view of a gas discharge switched electroluminescent display having color phosphors.

FIG. 5 illustrates a diagrammatic crosssectional view of a pixel triad of a color matrix panel which includes gas discharge switches in association with Red, Green, Blue (RGB) color phosphor stripes 29R (red), 29G (green) and 29B (blue) which can provide a color image. In operation, column electrodes 13R, 13G and 13B are selectively activated to select the particular colors red, green and blue and row electrodes are energized to provide pixels having desired colors. The gas discharge switches of FIG. 5 operate as described for FIG. 4 to activate the phosphor display cells.

Figure 6:
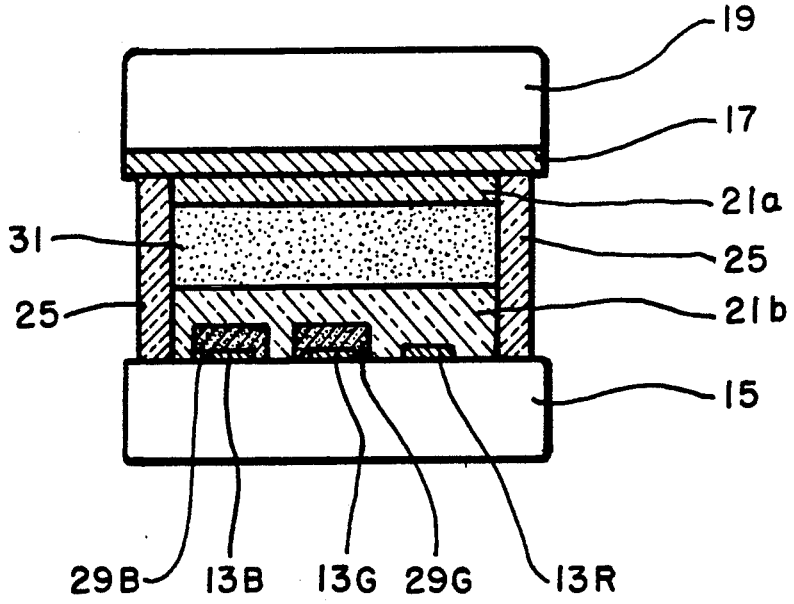
FIG. 6 is a diagrammatic cross-sectional view of an alternative embodiment of a gas discharge switched electroluminescent display having color phosphors.

FIG. 6 illustrates an alternative embodiment of display elements for a color panel. The display cell of FIG. 6 has only a green phosphor stripe 29G and a blue phosphor stripe 29B. Neon gas 31 is provided in the switch portion of the display element to provide the red color for the pixel triad. In manufacturing the display element of FIG. 6, glass frit is applied at high temperature so that it flows around the phosphor stripes 29B and 29G and fills the area around the electrode 13R. The frit then cools and forms the glass dielectric layer 21b which protects the phosphor stripes 29B and 29G by blocking ultraviolet light produced from the neon plasma. The glass layer 21b transmits the red light from the neon plasma in the area adjacent to the electrode 13R so that the red light can be viewed through the transparent substrate 15 and can combine with green and blue light of the phosphor stripes 29G and 29B to provide a desired color.

It should be understood that in the display of FIG. 6, other types of gas could be employed to produce other primary colors. Thus, for example, a gas could be selected to provide a blue light from the plasma. In such a device phosphors would be selected to provide red and green light which would be combined with the blue light of the plasma to provide selected colors. The invention is therefore not limited to particular gases or phosphors.

It should be understood that the scope of the invention is not limited by the particular embodiments which has been described or the materials which have been specified with respect to these embodiments. The metes and bounds of the invention are determined by the following claims and by the equivalents embodied therein.

We claim:

1. A display, comprising:

a plurality of conducting first electrode arranged parallel to one another;

a cover means for supporting said first electrodes;

first and second dielectric layers disposed in stacked spaced relation for forming a hermetically sealed gas chamber, the first electrodes abutting the first dielectric layer outside said chamber;

gas disposed in said chamber for selectively ionizing to provide a selected first color of light;

a plurality of conducting second electrodes disposed parallel to one another and orthogonal to said first electrodes and arranged in groups of three electrodes disposed side-by-side to form an electrode triad;

a plurality of electroluminescent phosphor stripes arranged in an alternating pattern to provide second and third colors of light and disposed adjacent and parallel to two of the electrodes of each triad, the third electrode of the triad having no associated phosphor stripe; and a transparent substrate for supporting said second electrodes and the overlying phosphor stripes against said second transparent dielectric layer outside said chamber, whereby the light of selectively ionized gas and selectively energized phosphor stripes forms pixels having selected colors.

2. The display of claim 1, wherein said gas provides red light when ionized and one of said phosphor stripes for a triad provides green light, the other phosphor stripe of the triad providing blue light when energized.

3. The color display of claim 1, wherein said gas provides blue light when ionized and one of said phosphor stripes for a triad provides green light, the other phosphor stripe of the triad providing red light when energized.

* * * * *